US007422509B2

(12) United States Patent
Fildan et al.

(10) Patent No.: US 7,422,509 B2
(45) Date of Patent: Sep. 9, 2008

(54) STRAP FASTENER

(75) Inventors: Gerhard Fildan, Vienna (AT); Karl Wanzenböck, Leobersdorf (AT)

(73) Assignee: Fildan Accessories Corporation, Humble, TX (US)

( * ) Notice: Subject to any disclaimer, the term of this patent is extended or adjusted under 35 U.S.C. 154(b) by 542 days.

(21) Appl. No.: 11/016,361

(22) Filed: Dec. 17, 2004

(65) Prior Publication Data

US 2006/0135039 A1 Jun. 22, 2006

(51) Int. Cl.
*A41C 3/00* (2006.01)
*A41C 3/12* (2006.01)

(52) U.S. Cl. ..... 450/86; 24/537; 24/336

(58) Field of Classification Search ..... 24/537, 24/298–302, 336, 337, 530, 535, 536, 330, 24/331; 450/86, 82, 88, 58; 2/338, 336, 2/327

See application file for complete search history.

(56) References Cited

U.S. PATENT DOCUMENTS

| | | | | |
|---|---|---|---|---|
| 763,793 | A * | 6/1904 | Pickert | 24/536 |
| 5,946,778 | A * | 9/1999 | McGarity | 24/536 |
| 6,321,422 | B1 * | 11/2001 | Fildan et al. | 24/537 |

* cited by examiner

*Primary Examiner*—Gloria Hale
(74) *Attorney, Agent, or Firm*—Andrew Wilford

(57) ABSTRACT

A strap fastener for a brassiere is configured as an alligator clip and has a slider which engages the ends of the legs of the fastener onto the fabric of a strapless brassiere or the like. The head of the fastener may be welded to the strap for a loop through which the strap is passed.

19 Claims, 3 Drawing Sheets

STRAP FASTENER

FIELD OF THE INVENTION

The present invention relates to a strap fastener for lingerie and particularly for brassieres. The invention also relates to an article of lingerie, especially a brassiere, provided with the strap fastener.

BACKGROUND OF THE INVENTION

In our U.S. Pat. No. 6,321,422, we have described a button clip which can be used between a strap and the body of a brassiere and which enables the clip to engage the fabric of a strapless brassiere when the user prefers a shoulder strap mode.

While that button clip was effective for use with lingerie items such as the strapless brassiere there described, improvement has been found to be desirable.

OBJECT OF THE INVENTION

It is the principal object of the present invention to provide an improved strap fastener for lingerie articles, especially brassieres which is esthetically pleasing and an improvement over prior art clips.

Another object of the invention is to provide a brassiere with an improved fastener between the strap and the brassiere body.

SUMMARY OF THE INVENTION

These objects and others are attained, in accordance with the invention in a strap fastener for a lingerie article comprising:

a fastener head adapted to be secured to a lingerie strap;

a pair of legs extending from the head and having juxtaposed free ends adapted to receive a fabric edge between them the legs having slots formed therein between the head and the ends; and a slider having an actuator body on one side of the fastener, a closing body on an opposite side of the fastener and a connecting portion guided in the slots and joining the bodies together, the slider being configured to draw the ends together upon movement of the slider in one direction along the legs and to enable the ends to spread apart upon movement of the slider in a direction opposite the one direction.

The brassiere comprises:

a cup-forming brassiere front and a brassiere back;

at least one shoulder strap connected between the brassiere front and back; and a strap fastener at one end of the strap and comprising:

a fastener head secured to the strap, a pair of legs extending from the head and having juxtaposed free ends adapted to receive a fabric edge between them, the legs having slots formed therein between the head and the ends, and a slider having an actuator body on one side of the fastener, a closing body on an opposite side of the fastener and a connecting portion guided in the slots and joining the bodies together, the slider being configured to draw the ends together upon movement of the slider in one direction along the legs and to enable the ends to spread apart upon movement of the slider in a direction opposite the one direction.

According to a feature of the invention, the head has either a surface which can be welded to the strap or a slot through which the strap can pass for securing the fastener to the strap.

The leg on the other side of the fastener can be formed with an elongated recess along the respective slot and in which the closing body can lie so as to be practically flush with the outer surface of that leg. The closing body can be elongated and at an extremity thereof can have a surface riding over a surface of that other leg and at least one of these surfaces can be toothed to retain the slider in a fabric clamping position upon movement of the slide in the closing direction.

It has been found to be advantageous to line at least one of the slits with an elongated member which can be inset in the respective leg. The head can be molded by injection molding onto a one-piece injection-molded member forming the legs and the slider can be a one-piece injection-molded member as well.

BRIEF DESCRIPTION OF THE DRAWING

The above and other objects, features, and advantages will become more readily apparent from the following description, reference being made to the accompanying drawing in which.

SPECIFIC DESCRIPTION

Figure 7:
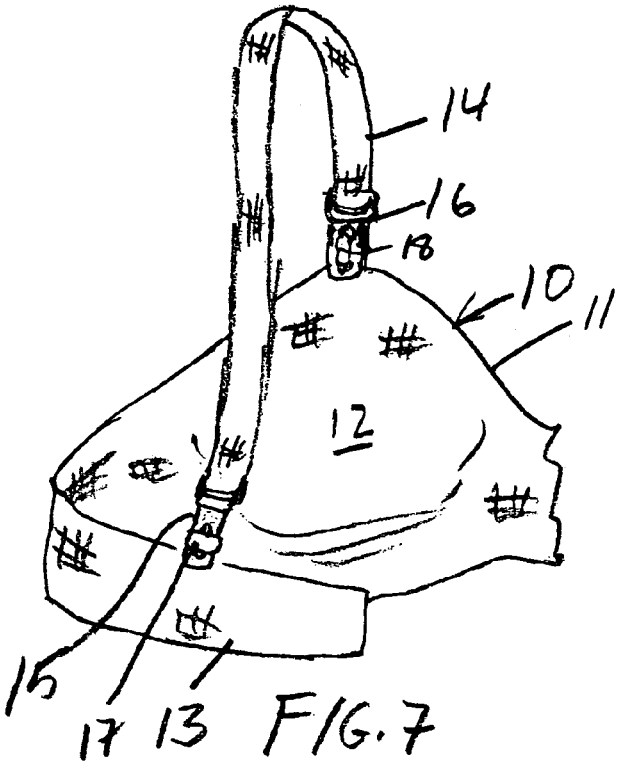
FIG. 7 is a fragmentary perspective view diagrammatically showing a strapless brassiere provided with an optional strap using the clips of the invention.

Referring first to FIG. 7 in which the body 10 of a strapless brassiere having a front part 11 provided with cups 12 and a back 13 has been shown, it can be seen that an optional strap 14 can be provided at its ends with clip-type strap fasteners 15 and 16 according to the invention that, by movement of respective sliders 17 and 18, can grip a fabric edge of the brassiere front 11 or the back 13 to secure the shoulder strap 14 to the brassiere.

In FIGS. 1 to 4, we have shown one embodiment of a lingerie strap clip according to the invention. In this embodiment, the clip 20 comprises a pair of legs 21, 22 joined together at 23 and injection molded in one piece therewith. At its upper end, the one-piece structure forming the legs 21 and 22 is embedded in a head 24 which can be provided with a transverse slot 25 adapted to receive the strap 14. The head 24 can be injection molded on the portion 23 joining the legs 21 and 22.

At the opposite outer or free ends of the legs 21 and 22, the inner surfaces of the legs confronting one another can be provided with teeth 26 and 27 to provide a firm grip on the fabric edge introduced between them. A slider 28 is movable longitudinally along the legs 21 and 22 from an open position (FIGS. 3 and 4) to a closed position (FIGS. 1 and 2) in which the fabric is released or engaged.

Figure 1:
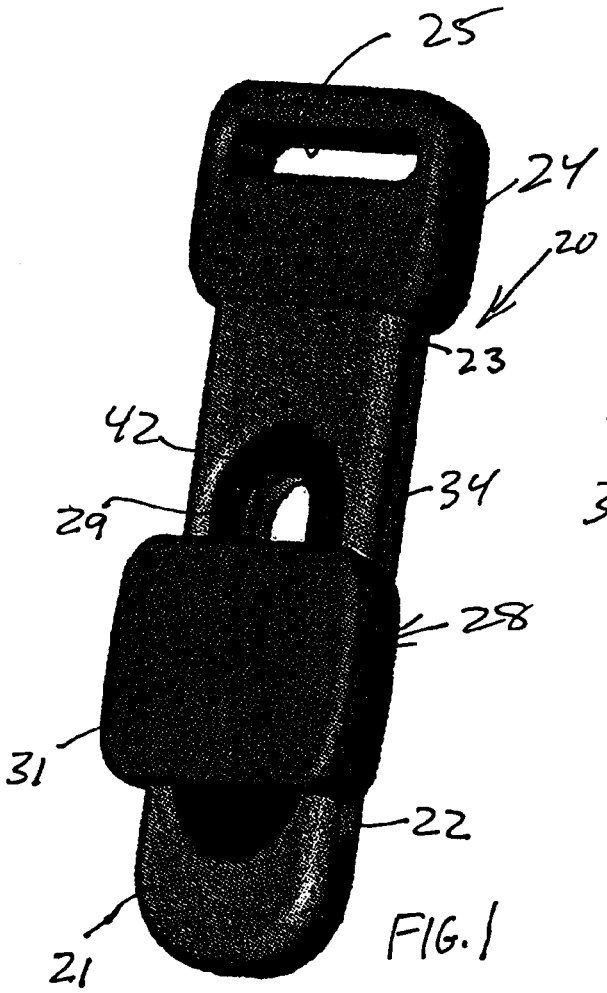
FIG. 1 is a perspective view showing a strap fastener according to the invention from one side.
Figure 2:
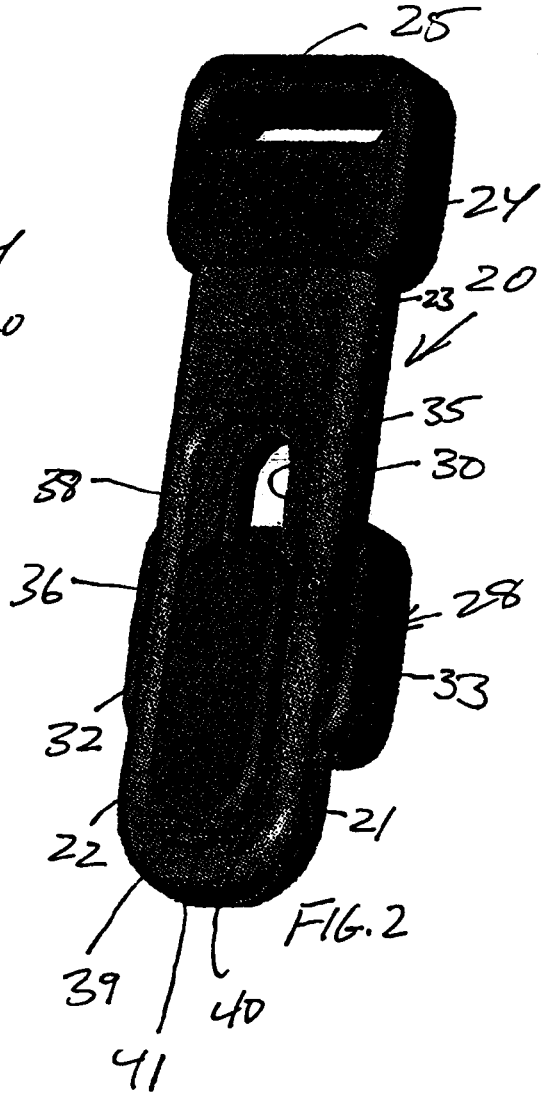
FIG. 2 is a perspective view of that strap fastener as seen from the other side.

To accommodate the slider 28, the leg 21 is formed with a longitudinally extending and transversely throughgoing guide slot 29 and the leg 22 is formed with a similar slot 30 as best seen in FIGS. 1 and 2. The slider 28, in turn, has an actuating body 31 of generally rectangular configuration and a pair of aprons 32 and 33 which can straddle the sides of the leg 21 and engage beneath it in grooves 34 and 35 along the edges of the legs 21 and 22.

Figure 4:
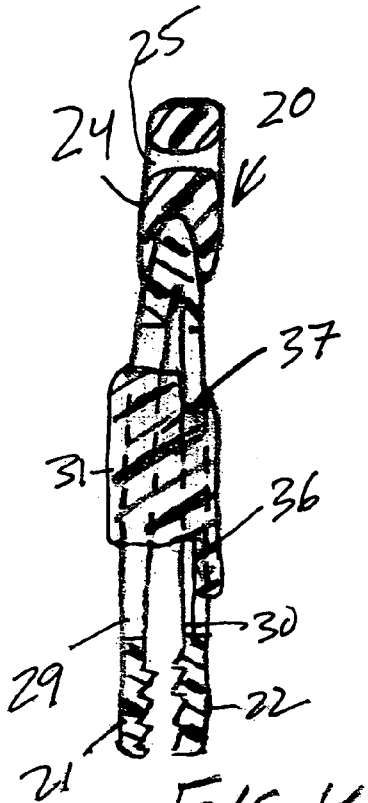
FIG. 4 is a longitudinal section through the fastener.

The actuating body 31, in turn, is joined to a closing body 36 on the opposite side of the slider 28 by a connecting piece 37 (FIG. 4). The parts 31, 36 and 37 of the slider can be formed in one piece if desired or can be fused together.

Figure 3:
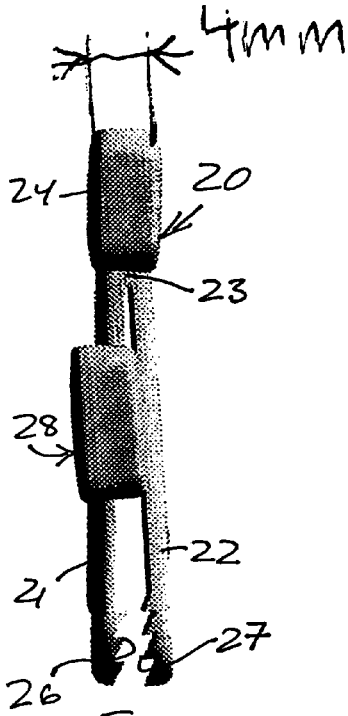
FIG. 3 is a side view of that fastener in an open position.

The actuating body 36 is elongated and lies in an elongated recess 38 of the leg 22 so as to be substantially flush with the outer surface of that leg 22. The leg 22 can have a surface 39 over which a cantilevered surface 40 of the body 36 may ride as the slider 28 is moved into its closing position so that the slider 28 can press the ends of the legs 21 and 33 together into the closing position. For this purpose, one or both of these surfaces may form an inclined ramp camming the ends of the legs 21 and 22 toward one another. At least one and preferably both of the surfaces 39 and 40 can be provided with teeth 41 to retain the clip in its closed position (FIGS. 1 and 2) until the slider 28 is forcibly shifted into its open position (FIGS. 3 and 4).

The slot 28 may have a liner 42 formed by an oval ring inset in the leg 21. The ring 42 may also be provided with detents to hold the slider 28 in the closed position of the fastener.

In operation, once the strap 14 is threaded through the slot 25 and secured in place, the clip is opened by movement of the slider 28 toward the head 24 and the fabric edge of the brassiere is inserted between the teeth 26, 27 of the outer ends of the legs 21 and 22. The slider 28 is then shifted outward toward those ends to clamp the fabric edge between them.

Figure 5:
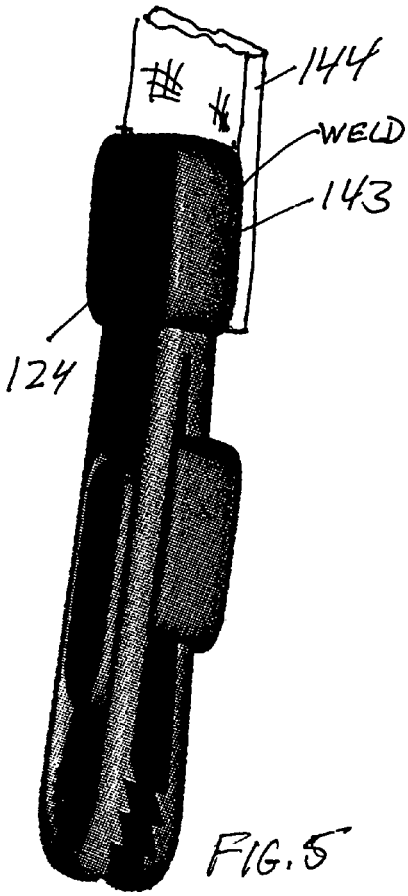
FIG. 5 is a view similar to FIG. 2 showing a second embodiment.
Figure 6:
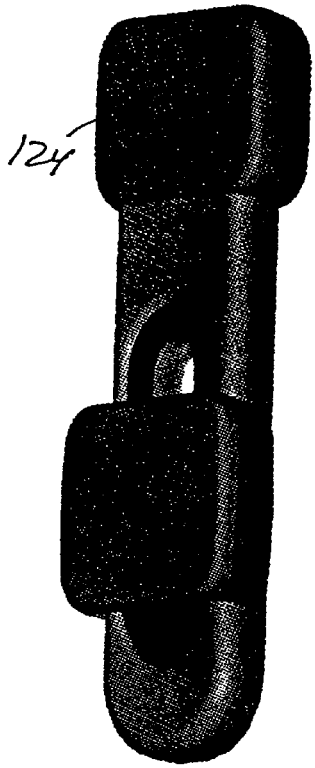
FIG. 6 is a view similar to FIG. 1 of the second embodiment.

In the embodiment of FIGS. 5 and 6, the head 124 is welded at 143 to the strap 144. Otherwise, fasteners of FIGS. 5 and 6 are identical to those of FIGS. 1 through 4.

The clip can be used to attach a brassiere strap, looped through the slot 25, to a brassiere cup 12 by engaging the brassiere cup 12 between the ends of the legs 21 and 22. In that case, the recessed portion 36 of the slider 28 may face forward to provide a relatively smooth front for the clip whereas the back 31 of the slider 28 may be located adjacent a cushioned portion of the brassiere so that it will not press against the body of the wearer excessively.

We claim:

1. A strap fastener for a lingerie article, the fastener comprising:

a fastener head adapted to be secured to a lingerie strap;

a pair of legs extending from said head and having juxtaposed free ends adapted to receive a fabric edge of the lingerie article between them, the legs being shiftable between an open position with the free ends widely spaced and a closed position with the free ends closely juxtaposed, the fabric edge of the lingerie article being grippable between the free ends in the closed position, said legs having elongated, throughgoing, and transversely aligned guide slots formed therein between said head and said ends, one of the legs being formed along the respective slot with a recess inset from an outer surface of the one leg; and a slider having an actuator body on one side of said fastener, a closing body on an opposite side of said fastener at the one leg and a connecting portion guided in said slots and joining the closing body to the actuator body, the closing body fitting generally complementarily in the slot and recess of the one leg so as to be generally flush with the outer surface of the one leg, said slider being configured to draw said ends together upon movement of said slider in an outward direction along said legs toward the free ends thereof and to enable said ends to spread apart upon movement of said slider in an opposite inward direction away from the free ends.

2. The strap fastener defined in claim 1 wherein said head has another slot through which said strap can pass for securing said fastener to said strap.

3. The strap fastener defined in claim 1 wherein said closing body is elongated.

4. The strap fastener defined in claim 3 wherein said closing body has an extremity with a cam surface riding over a cam surface of said leg on said other side of said fastener.

5. The strap fastener defined in claim 1 wherein at least one of said guide slots is lined with an elongated member inset in the respective leg.

6. The strap fastener defined in claim 1 wherein said head is unitary with said legs.

7. The strap fastener defined in claim 6 wherein said legs are one piece.

8. The strap fastener defined in claim 1 wherein said actuator body has a substantially rectangular configuration.

9. A brassiere comprising:

a brassiere front and a brassiere back;

at least one shoulder strap connected between said brassiere front and back; and a strap fastener at one end of said strap and comprising:

a fastener head mounted on said strap, a pair of legs extending from said head and having juxtaposed free ends adapted to receive a fabric edge of the front or back between them, said legs being formed with transversely throughgoing and aligned and longitudinally extending guide slots between said head and said ends, one of the legs being formed along the respective slot with a recess inset from an outer surface of the one leg, and a slider having an actuator body on the other of the legs, a closing body on the one leg and a connecting portion guided in said slots and joining said bodies together, the closing body fitting generally complementarily in the slot and recess of the one leg so as to be generally flush with the outer surface of the one leg, said slider being configured to draw said ends together upon outward longitudinal movement of said slider along said legs and to enable said ends to spread apart upon movement of said slider in an opposite longitudinally inward direction away from the free ends.

10. The brassiere defined in claim 9 wherein said head has another slot through which said strap can pass for securing said fastener to said strap.

11. The brassiere defined in claim 9 wherein said closing body is elongated.

12. The brassiere defined in claim 11 wherein said closing body has an extremity with a cam surface riding over a cam surface of said leg on said other side of said fastener.

13. The brassiere defined in claim 12 wherein at least one of said cam surfaces is toothed to retain said slider in a fabric-clamping position upon movement of said slider in said one direction.

14. The brassiere defined in claim 13 wherein the recess of the one leg is lined with an elongated member inset in the respective leg.

15. The brassiere defined in claim 14 wherein said head is unitary with said legs.

16. The brassiere defined in claim 15 wherein said legs are one piece.

17. The brassiere defined in claim 16 wherein said actuator body has a substantially rectangular configuration.

18. In combination with a lingerie article having a fabric edge and with a flexible strap, a fastener clip comprising:

a fastener head adapted to be secured to the strap;

a pair of elastically deflectable legs extending outward generally parallel to each other from the head and having outer ends shiftable transversely between a relatively widely spaced open a position and a closely juxtaposed closed position, the legs being formed with similar elongated and throughgoing guide slots extending between the head and the respective free ends;

a slider having a connecting portion extending transversely through both of the guide slots and shiftable axially therealong, an actuator body fixed to one end of the connecting portion and riding on one of the legs, and a closing body fixed to an opposite end of the connecting portion and bearing toward the actuator body on the other of the legs, the closing body and the other leg being formed with interengaging formations that lock together in an outer end position of the slider and impede longitudinal movement of the slider.

19. The combination defined in claim 18 wherein the formations are interengageable teeth.

* * * * *